US007083325B2

(12) United States Patent
Clot et al.

(10) Patent No.: US 7,083,325 B2
(45) Date of Patent: Aug. 1, 2006

(54) CONTROL MECHANISM FOR WATCH PART

(75) Inventors: Cyrille Clot, La Chaux-de-Fonds (CH); Nicolas Dehon, La Chaux-de-Fonds (CH); Yves Corthesy, La Chaux-de-Fonds (CH)

(73) Assignee: Girard-Perregaux S.A., La Chaux-de-Fonds (CH)

( * ) Notice: Subject to any disclaimer, the term of this patent is extended or adjusted under 35 U.S.C. 154(b) by 0 days.

(21) Appl. No.: 10/510,970

(22) PCT Filed: Mar. 26, 2003

(86) PCT No.: PCT/CH03/00197

§ 371 (c)(1),
(2), (4) Date: Mar. 16, 2005

(87) PCT Pub. No.: WO03/085461

PCT Pub. Date: Oct. 16, 2003

(65) Prior Publication Data

US 2005/0157594 A1 Jul. 21, 2005

(30) Foreign Application Priority Data

Apr. 9, 2002 (EP) ..... 02405281

(51) Int. Cl.
*G04B 27/02* (2006.01)
*G04B 29/00* (2006.01)

(52) U.S. Cl. ..... 368/190; 368/319

(58) Field of Classification Search ..... 368/185, 368/190–199, 206, 308, 319–321
See application file for complete search history.

(56) References Cited

U.S. PATENT DOCUMENTS 3,827,235 A * 8/1974 Bachmann ..... 368/190
4,415,277 A * 11/1983 Ganter ..... 368/190
4,845,693 A * 7/1989 Kubota ..... 368/185
5,303,213 A * 4/1994 Kaelin ..... 368/185
6,711,099 B1 * 3/2004 Mock et al. ..... 368/31

FOREIGN PATENT DOCUMENTS

CH 8 819 2/1895
CH 343 917 A 12/1959

OTHER PUBLICATIONS

Chs-A Reymondin et al. p. 40 Fédération des Ecoles Techniques de Suisse ISBN 2-940025; 1998.

* cited by examiner

*Primary Examiner*—Vit W. Miska
(74) *Attorney, Agent, or Firm*—Browning Bushman, P.C.; Hugh R. Kress

(57) ABSTRACT

The invention relates to a control mechanism for a timepiece of the type comprising a frame (10) defining a reference plane and, secured to this frame:

Figure 1B:
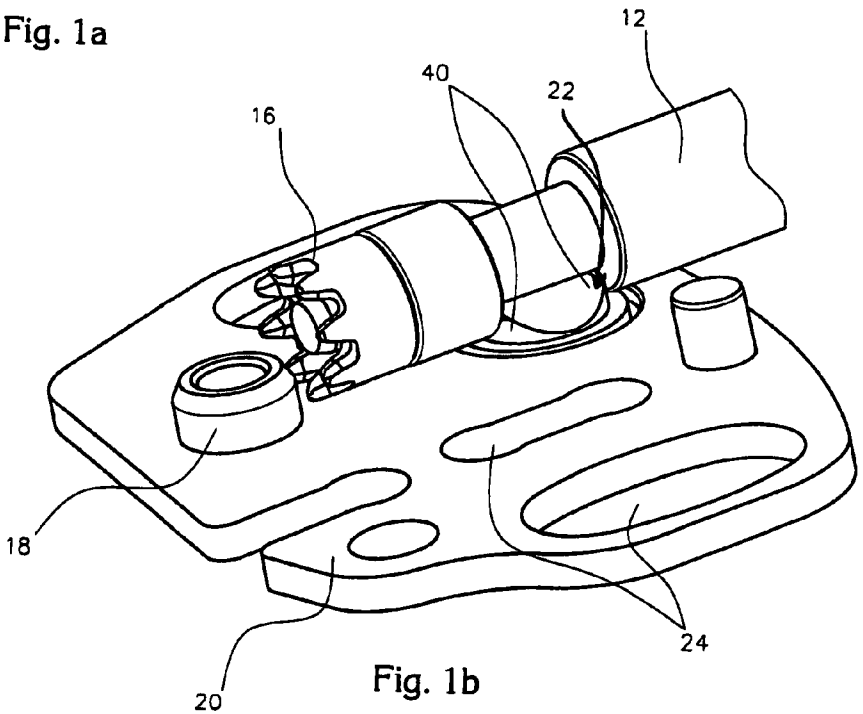

a control rod (12) furnished with an annular groove (14) having a width l, an external diameter D and an internal diameter d, mounted so as to move in translation on the frame (10) along a first axis (AA') included in said plane, and a retaining plate (20) mounted on the frame (10) parallel to said plane and comprising a locking piece (22) mounted so as to rotate about a second axis (BB') perpendicular to the reference plane and interacting with said rod (12) by engagement in the groove (14), in order to limit its translational movement.

16 Claims, 2 Drawing Sheets

CONTROL MECHANISM FOR WATCH PART

The present invention relates to control mechanisms of a timepiece of the type comprising:

a frame, furnished with two parallel faces, one of which is intended to support a dial and the other is opposite the back, a control rod, mounted mobile in translation on the frame and comprising an annular groove, and a retaining plate mounted mobile on the frame.

More particularly, the invention concerns the time-setting mechanisms for which the control rod is a time-setting rod and the retaining plate is a pull-out.

In these timepieces, control is via a translation and rotation movement of the rod, via a crown wheel with which it is fitted at its outer end. According to the axial position of the rod, it is possible, by rotating it, to correct one or other of the information items displayed, usually the date in the first pulled out position and the time in the second.

So that the rod can perform its function in satisfactory conditions, its movement must be limited axially. Accordingly, the pull-out is furnished with a stud engaged in the groove of the rod.

In most mechanisms, the pull-out is on the dial side of the watch. A screw or a pin is accessible from the back side so that the pull-out can be pushed in such a way that the stud comes out of the groove during the operation to push in and pull out the rod. This operation is tricky, because it requires two simultaneous movements, both the movement of the pull-out and the pulling out of the rod.

A gear mounted on the time-setting rod is kinematically connected, via an angle transmission, to the time-setting movement or to the date-correction movement, according to the position of the rod. The moving of the gear against the first angle transmission is provided by a mechanism consisting of the pull-out and a lever. The pull-out interacts with the lever at its end opposite the end supporting the stud. The lever then moves the gear, by pressing on one or other of the sides of a groove made in the thickness of the gear. This mechanism is well known to those skilled in the art and is, for example, described in the book on the theory of clockmaking by Chs-A Reymondin et al, page 40 (Fédération des Ecoles Techniques de Suisse, 1998, ISBN 2-940025).

The patent CH 8 819 describes a time-setting mechanism in which the pull-out is on the back side and its pull-out stud is replaced by a pivot screw, which thus prevents any translation movement of the rod. It is therefore necessary to loosen the screw to release the rod. This device has at least two major disadvantages. First of all, the lever into which the screw passes must be of sufficient thickness that a tapping can be made in it capable of firmly retaining the screw. This increases the thickness of the movement by the same amount. Furthermore, it is never guaranteed that a tightened screw will not loosen under the effect of the vibrations.

The present invention proposes a solution making it easier to pull out and push in the time-setting rod without having to simultaneously push the pull-out and avoiding the disadvantages of the solution proposed in the abovementioned patent.

More precisely, the invention relates to a control mechanism for timepiece of the type comprising a frame furnished with two parallel faces defining a reference plane, one of which is intended to support a dial and the other is opposite the back. The mechanism also comprises, secured to this frame:

a control rod furnished with an annular groove having a width l, an external diameter D and an internal diameter d, mounted so as to move in translation on the frame along a first axis AA' included in said plane, and a retaining plate mounted on the frame parallel to the plane and comprising a locking piece interacting with the rod by engagement in the groove, in order to limit its translational movement.

The retaining plate is mounted on the back side and supports the locking piece, mounted so as to rotate about a second axis BB' perpendicular to the reference plane. It is arranged such that it is capable of occupying a first position, called the locking position, in which the translation movement of the rod is limited by the engagement of the locking piece in the groove and a second position, called the unlocking position, in which said piece is no longer engaged in the groove, thus allowing the rod to be pushed in on the frame or pulled out.

According to the invention, the locking piece comprises:

a first part of general cylindrical form, engaged in the retaining plate in order to allow its rotation on the plate, a second part disposed on the side opposite to the rod and arranged to allow the locking piece to rotate, and a third part, disposed on the side of the rod, intended to interact with it and comprising, for this purpose, two wings inscribed in a dummy cylinder of the same axis as the second axis BB' and of slightly smaller diameter than the width l of the groove, said wings being arranged such that, in the locking position, they are inscribed in the external diameter D of the groove and take on the contour of the internal diameter d and, in the unlocking position, they take on the contour of the external diameter D.

The following description refers to a control mechanism consisting of a time-setting rod that can terminate in a gear which is secured to it in rotation and in translation and to a retaining plate consisting of a pull-out that can move in translation.

It is advantageous that the locking piece comprises positioning means ensuring that it is retained in the locked and unlocked positions. They are formed by a frictional engagement of a part of the locking piece on the retaining plate and, in a particularly advantageous embodiment, by the wings which extend on the sides of the groove beyond its bottom, and whose free end takes on, in the locked position, the contour of the internal diameter d, in such a way as to define a notch engagement.

Figure 1A:
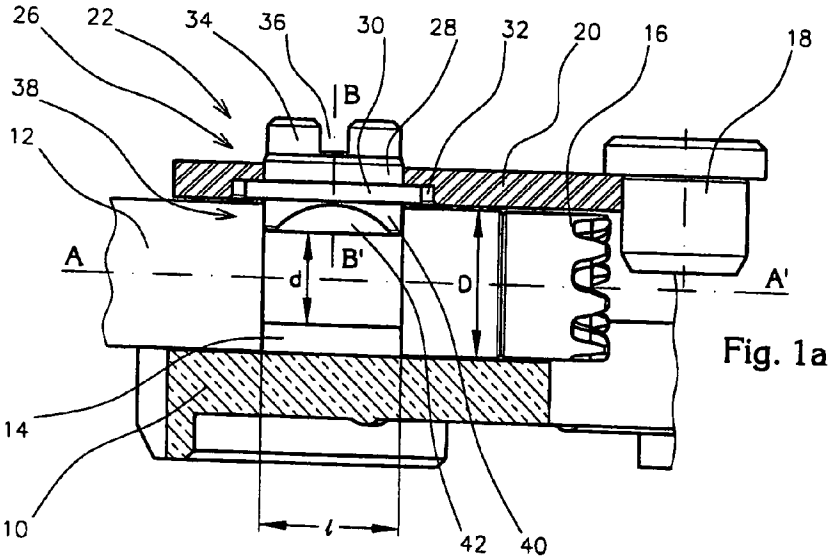

The invention will be better understood on reading the following description made with reference to the appended drawing, in which the FIGS. 1*a, b, c* and 2*a, b, c* are representations of a mechanism according to the invention, in locked and unlocked position, respectively in inverted perspective at b, in longitudinal section at a and transverse section at c along the axis of the rod.

FIG. 1*a* shows a portion of watch movement, and more particularly at 10 a frame, for example a mainplate, furnished with two parallel faces defining a reference plane, one of which is intended to support a dial and the other is facing the back. A time-setting rod 12, furnished with an annular groove 14 possessing a width l, an external diameter D and an internal diameter d, is mounted so as move translationally and rotationally in the frame 10, along a first axis (AA') included in the reference plane. The end of the rod 12 inserted into the mechanism of the watch consists of a tooth gear 16, interacting with a time-setting angle transmission which is not shown in the drawing and which pivots on a stud 18.

Now, with reference to FIG. 1*b*, a pull-out 20 is mounted so as to move in translation in the reference plane. It supports the stud 18 and comprises a locking piece 22 interacting with the rod 12 by engagement in its groove 14, thus making the rod 12 and the pull-out 20 integral in translation. The pull-out 20 is also used to position the rod 12 in the thickness of the movement.

The pull-out 20 is provided with holes 24 which engage with the studs attached to the frame, not shown in the drawing, in order to guide it during its translational movements.

The locking piece 22 is arranged so as to be able to occupy two positions, either the one called the locking position, in which the rod 12 and the pull-out 20 are integral in translation and the other, called the unlocking position in which it is possible to pull out the rod or push it in.

The piece 22 comprises a first mid-part 26, of general cylindrical shape, of which a first portion 28 is in frictional engagement in the pull-out 20 in order to allow its rotation along a second axis BB', that passes, in dummy fashion, vertically through the center of the groove 14 when the rod is in place and of which a second portion 30, of greater diameter, is engaged in a countersinking 32 formed in the thickness of the pull-out 20 and pressing against its bottom, in order to axially position the piece 22.

A second, upper, part 34 of the locking piece 22 is furnished with a slot 36 passing through it radially so that it can allow the engagement of a flat screwdriver in order to rotate the piece 22.

Finally, the piece 22 terminates, on the side of the time-setting rod 10, in a third part 38 which comprises two wings 40, separated by an opening 42 passing through it horizontally, and placed symmetrically relative to a vertical plane which, in the unlocked position, includes the axis AA'. As shown in FIG. 2, the wings 40 are intended to interact with the groove 14 when the piece 22 is in locked position. Accordingly, they are dimensioned such that they are inscribed in a dummy cylinder with the same axis as the second axis BB' and with a diameter slightly smaller than the width l of the groove 14.

Figure 1C:
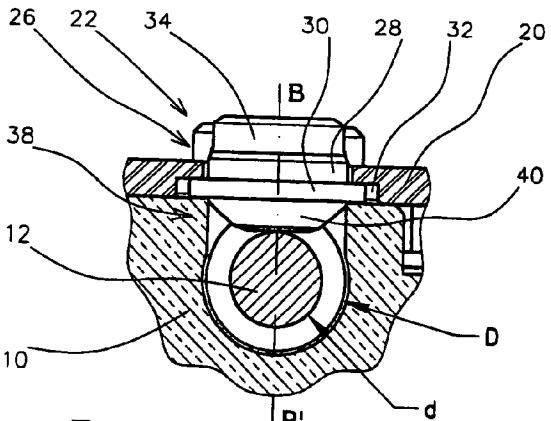

The locking piece 22 is therefore mobile in rotation along the axis BB'. The wings 40 of the part 38 of the piece 22 are arranged such that in locked position, visible in FIG. 1*c*, they are inscribed in the external diameter D of the groove 14 and take on the contour of the internal diameter d. The wings 40 of the part 38 thus occupy practically all the space lying between the walls of the groove 14, such that the rod 12 and the pull-out 20 move integrally in translation.

Figures 2A, 2B, 2C:
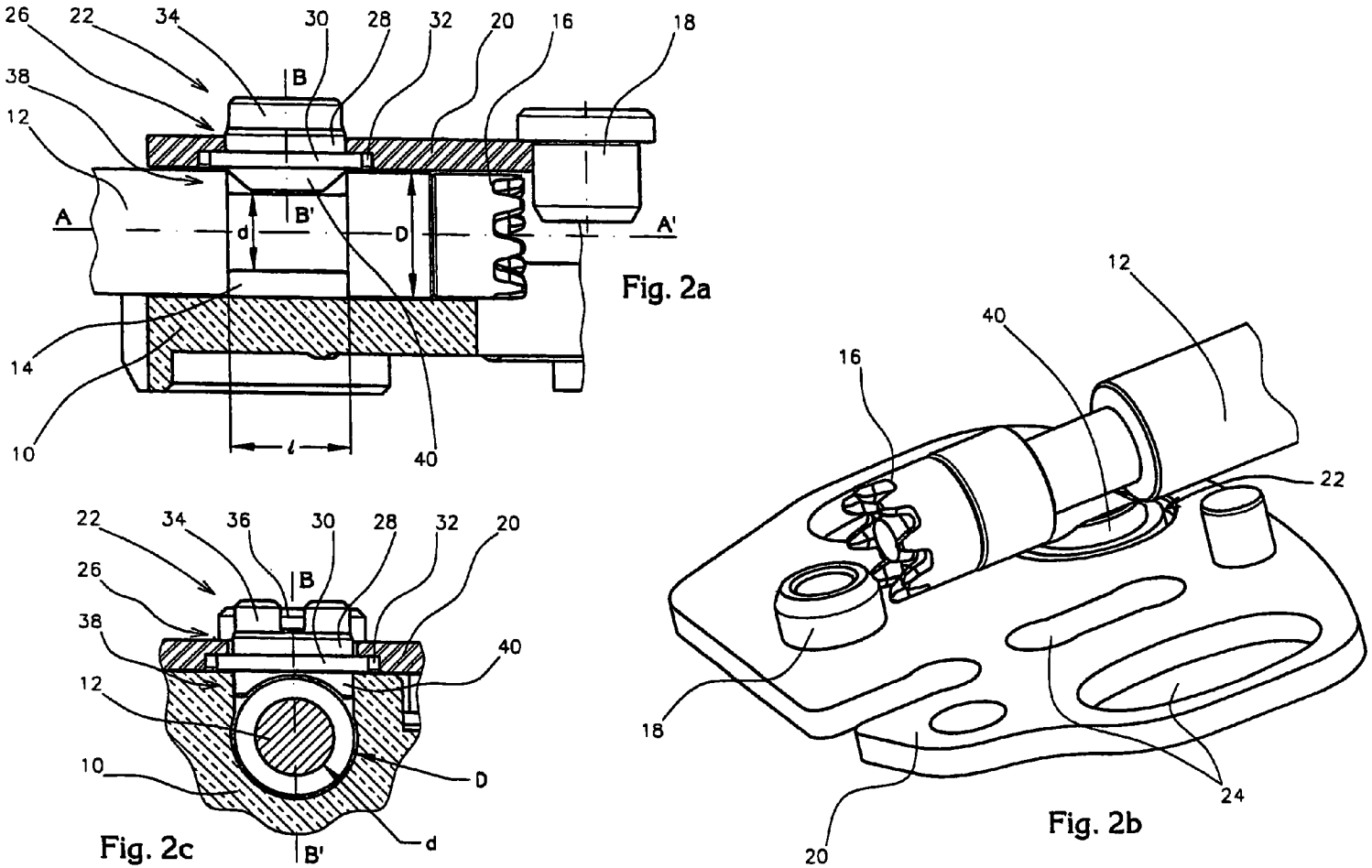

A quarter turn rotation of the locking piece 22 is used to move to the second unlocked position, visible in FIG. 2*c*, in which the wings 40 take on the contour of the external diameter D of the groove 14. The axis AA' is then included in the plane of symmetry of the wings 40. In this position, the groove 14 is released and the rod 10 can be moved in translation independently of the pull-out 20, to allow it to be pushed in or pulled out.

Therefore, a locking piece has thus been produced which can be used to move, without dismantling pieces, from a locked position to an unlocked position, these two positions being stable. In locked position the time-setting rod and the pull-out are perfectly integral in translation, while in the unlocked position, the rod can easily be pulled out or pushed in.

In one variant, the wings 40, in the locked position, extend on the sides of the groove 14, beyond its bottom, their free end espousing the contour of the internal diameter d to ensure that the locking position is maintained with a notch.

To pass over the locking notch, the applied rotation force must overcome the forces of elastic resistance exerted by the rod 12 and by the pull-out 20. The wings 40 press on the bottom of the groove 14 and slightly move the rod 12 and the pull-out 20, in order to allow their passage and the transition to the unlocked position. In this case, the mid-part 26 can be mounted free onto the pull-out 20, the position of the locking piece 22 being ensured by the notch.

The description that has just been made applies to a time-setting rod, but it goes without saying that the invention can very well be adapted to any control rod and even to a pushbutton likely to be operated by a movement in translation. In this case, the retaining plate of the locking piece may be fixed. It may also involve a flip-flop lever controlled by the pushbutton and forming part, for example, of a chronograph mechanism.

What is claimed is:

1. A control mechanism for timepiece of the type comprising a frame (10) furnished with two parallel faces defining a reference plane, one of which is intended to support a dial and the other is opposite the back, and, secured to this frame:

a control rod (12) furnished with an annular groove (14) having a width l, an external diameter D and an internal diameter d, mounted so as to move in translation on the frame (10) along a first axis (AA') included in said plane, and a retaining plate (20) mounted, on the back side, on the frame (10) parallel to said plane and comprising a locking piece (22) mounted so as to rotate about a second axis (BB') perpendicular to the reference plane and arranged such that it is capable of occupying:

a first position, called the locking position, in which the translation movement of said rod (12) is limited by the engagement of the locking piece (22) in the groove (14), and a second position, called the unlocking position, in which said locking piece (22) is no longer engaged in the groove (14) thus allowing the rod (12) to be pushed in on the frame (10) or pulled out, characterized in that said locking piece (22) comprises:

a first part (26) of general cylindrical form, engaged in the retaining plate (20) in order to allow its rotation on the plate;

a second part (34) disposed on the side opposite to the rod (12) and arranged to allow said locking piece (22) to rotate, and a third part (38), disposed on the side of the rod (12), intended to interact with it and comprising, for this purpose, two wings (40) inscribed in a dummy cylinder of the same axis as the second axis (BB') and of slightly smaller diameter than the width l of the groove (14), said wings being arranged such that, in the locking position, the wings (40) are at least partly inscribed in the space between the external diameter D of the groove (14) and the internal diameter d and, in the unlocking position, the wings (40) take on the contour of the external diameter D.

2. The control mechanism as claimed in claim 1, characterized in that the control rod (12) is a time-setting rod and in that the retaining plate (20) is a pull-out.

3. The control mechanism as claimed in claim 2, characterized in that the pull-out (20) can move in translation.

4. The control mechanism as claimed in claim 2, characterized in that the time-setting rod (12) terminates in a gear (16) which is integral therewith in rotation and in translation.

5. The control mechanism as claimed in claim 1, characterized in that said locking piece (22) comprises positioning means ensuring that it is retained in the locked and unlocked positions.

6. The control mechanism as claimed in claim 5, characterized in that said positioning means are formed by a frictional engagement of a part (26) of the locking piece (22) on the retaining plate (20).

7. The control mechanism as claimed in claim 5, characterized in that said positioning means are formed by the wings (40) which extend on the sides of the groove (14) beyond its bottom, and whose free end takes on, in the locked position, the contour of the internal diameter d, in such a way as to define a notch engagement.

8. The control mechanism as claimed in claim 2, characterized in that said locking piece (22) comprises positioning means ensuring that it is retained in the locked and unlocked positions.

9. The control mechanism as claimed in claim 3, characterized in that said locking piece (22) comprises positioning means ensuring that it is retained in the locked and unlocked positions.

10. The control mechanism as claimed in claim 4, characterized in that said locking piece (22) comprises positioning means ensuring that it is retained in the locked and unlocked positions.

11. The control mechanism as claimed in claim 8, characterized in that said positioning means are formed by a frictional engagement of a part (26) of the locking piece (22) on the retaining plate (20).

12. The control mechanism as claimed in claim 9, characterized in that said positioning means are formed by a frictional engagement of a part (26) of the locking piece (22) on the retaining plate (20).

13. The control mechanism as claimed in claim 10, characterized in that said positioning means are formed by a frictional engagement of a part (26) of the locking piece (22) on the retaining plate (20).

14. The control mechanism as claimed in claim 8, characterized in that said positioning means are formed by the wings (40) which extend on the sides of the groove (14) beyond its bottom, and whose free end espouses, in the locked position, the contour of the internal diameter d in such a way as to define a notch engagement.

15. The control mechanism as claimed in claim 9, characterized in that said positioning means are formed by the wings (40) which extend on the sides of the groove (14) beyond its bottom, and whose free end takes on, in the locked position, the contour of the internal diameter d, in such a way as to define a notch engagement.

16. The control mechanism as claimed in claim 10, characterized in that said positioning means are formed by the wings (40) which extend on the sides of the groove (14) beyond its bottom, and whose free end takes on, in the locked position, the contour of the internal diameter d, in such a way as to define a notch engagement.

* * * * *